US005704550A

United States Patent [19]

Foster et al.

[11] Patent Number: 5,704,550

[45] Date of Patent: Jan. 6, 1998

[54] LIQUID DISPENSER WITH FLOW CONTROL

[75] Inventors: Donald D. Foster, St. Charles; Philip L. Nelson, Ellisville; Martin S. Laffey, St. Charles, all of Mo.

[73] Assignee: Contico International, Inc., St. Louis, Mo.

[21] Appl. No.: 569,878

[22] Filed: Dec. 8, 1995

[51] Int. Cl.[6] ..... B05B 9/043; B05B 1/34

[52] U.S. Cl. ..... 239/333; 239/480; 239/493; 239/578

[58] Field of Search ..... 239/333, 476–483, 239/491–493, 569, 578, 583

[56] References Cited

U.S. PATENT DOCUMENTS

| | | | |
|---|---|---|---|
| 1,452,264 | 4/1923 | Binks . | |
| 1,480,594 | 1/1924 | Binks . | |
| 1,571,629 | 2/1926 | Huge . | |
| 1,686,885 | 10/1928 | Trisler . | |
| 1,843,411 | 2/1932 | Woolley . | |
| 1,979,179 | 10/1934 | Taylor . | |
| 2,128,494 | 8/1938 | Morrow . | |
| 2,621,076 | 12/1952 | Barton . | |
| 2,626,185 | 1/1953 | Roselund . | |
| 2,674,493 | 4/1954 | Raskin et al. . | |
| 2,969,926 | 1/1961 | Peeps . | |
| 3,120,347 | 2/1964 | Duke, Jr. . | |
| 4,651,929 | 3/1987 | Kränzle | 239/526 X |
| 5,152,461 | 10/1992 | Proctor | 239/304 |
| 5,190,191 | 3/1993 | Reyman | 222/256 |
| 5,303,853 | 4/1994 | Nye | 222/212 |
| 5,363,991 | 11/1994 | Reyman | 222/207 |
| 5,402,916 | 4/1995 | Nottingham et al. | 222/134 |
| 5,593,094 | 1/1997 | Barriac et al. | 239/476 |

FOREIGN PATENT DOCUMENTS

| | | |
|---|---|---|
| 47-44308 | 12/1972 | Japan . |
| 52-29289 | 7/1977 | Japan . |
| 53-5417 | 1/1978 | Japan . |
| 54-35682 | 11/1979 | Japan . |
| 1201705 | 8/1970 | United Kingdom . |
| 1251118 | 10/1971 | United Kingdom . |

OTHER PUBLICATIONS

Japanese application filed 1990, application number unknown, May, 1990.

*Primary Examiner*—Lesley D. Morris
*Attorney, Agent, or Firm*—Howell & Haferkamp, L.C.

[57] ABSTRACT

A liquid dispenser comprises a dispenser body and a flow restrictor. The dispenser body has a pump mechanism, an intake port adapted for fluid communication with a source of liquid, an intake liquid flow path providing fluid communication between the intake port and the pump mechanism, a discharge port, and a discharge liquid flow path providing fluid communication between the pump mechanism and discharge port. The flow restrictor is in the discharge liquid flow path and is moveable between first and second positions. The flow restrictor is configured for permitting fluid flow from the pump mechanism to the discharge port when the flow restrictor is in its first position, and is configured for at least partially impeding fluid flow from the pump mechanism to the discharge port when the flow restrictor is in its second position.

25 Claims, 7 Drawing Sheets

LIQUID DISPENSER WITH FLOW CONTROL

BACKGROUND OF THE INVENTION

This invention relates to a liquid dispenser and more particularly to a pump-type dispenser.

A pump-type dispenser, such as a trigger sprayer, typically includes a dispenser body having a manually operated pump which draws liquid from a source of liquid (e.g., a container) and dispenses it through a nozzle via a liquid flow path in the dispenser body. A check valve within the liquid flow path and upstream of the pump permits fluid flow from the container to the pump, but checks fluid flow from the pump back to the container. Another check valve within the liquid flow path and downstream of the pump permits fluid flow from the pump to the nozzle, but checks fluid flow from the nozzle to the pump. Depending on the shape and configuration of the nozzle, liquid may be dispensed as a stream, spray, or foam. In one such type of sprayer, the dispensing pattern may be adjusted (e.g., from stream to spray or vice versa) by turning the nozzle relative to the dispenser body about a nozzle axis or by pushing or pulling the nozzle relative to the dispenser body to thereby reposition the nozzle along the nozzle axis. Some sprayers have flaps which are pivotally attached to the dispenser body for movement between first and second positions. In the first position, the flap is away from the orifice and does not contact the dispensed liquid. In the second position, the flap is directly in front of and adjacent the nozzle orifice. The flap may have a fluid passageway extending therethrough. Liquid exiting the nozzle orifice when the flap is in its first position is typically dispensed in a spray pattern. However, the fluid passageway may be configured so that when the flap is in its second position, liquid exiting the nozzle orifice passes through the fluid passageway and is dispensed therefrom as a stream or as a foam. In another type of sprayer, the flap has a seal configured such that when the flap is in its second position, the seal covers the nozzle orifice to prevent the dispensing of liquid from the nozzle orifice.

Because the fluid stream is adjusted (or blocked) by manipulating either the nozzle or a flap adjacent the nozzle orifice, the user may accidentally come into contact with the liquid. Depending upon the type of liquid discharged, the user's hands might become sticky, slippery, stained or irritated (in the case of caustic liquid).

SUMMARY OF THE INVENTION

Among the several objects of the present invention may be noted the provision of an improved pump-type dispenser; the provision of such a dispenser in which the pattern of liquid dispensed therefrom may be altered without a substantial risk of the user coming into contact with the dispensed liquid; the provision of such a dispenser in which the pattern of liquid dispensed therefrom may be controlled remotely relative to the nozzle of the dispenser; the provision of such a dispenser which is of relatively simple construction.

In general, a liquid dispenser of the present invention comprises a dispenser body and a flow restrictor. The dispenser body has a pump mechanism, an intake port adapted for fluid communication with a source of liquid, an intake liquid flow path providing fluid communication between the intake port and the pump mechanism, a discharge port, and a discharge liquid flow path providing fluid communication between the pump mechanism and discharge port. A first check valve is in the intake liquid flow path and is configured for permitting fluid flow from the intake port to the pump mechanism and for checking fluid flow from the pump mechanism to the intake port. A second check valve is in the discharge liquid flow path and is configured for permitting fluid to flow downstream from the pump mechanism to the discharge port and for checking fluid flow from the discharge port to the pump mechanism.

The flow restrictor is in the discharge liquid flow path and is moveable between first and second positions. The flow restrictor is configured for permitting fluid flow from the pump mechanism to the discharge port when the flow restrictor is in its first position, and is configured for at least partially impeding fluid flow from the pump mechanism to the discharge port when the flow restrictor is in its second position.

In another aspect of the present invention, a liquid dispenser comprises a dispenser body and a flow restrictor. The dispenser body has a pump mechanism, an intake port adapted for fluid communication with a source of liquid, an intake liquid flow path providing fluid communication between the intake port and the pump mechanism, a discharge port, and a discharge liquid flow path providing fluid communication between the pump mechanism and discharge port. A first check valve is in the intake liquid flow path and is configured for permitting fluid flow from the intake port to the pump mechanism and for checking fluid flow from the pump mechanism to the intake port. A second check valve is in the discharge liquid flow path and is configured for permitting fluid to flow downstream from the pump mechanism to the discharge port and for checking fluid flow from the discharge port to the pump mechanism. The flow restrictor is in the discharge liquid flow path and is moveable relative to the dispenser body between a first position in which the flow restrictor is spaced a first distance from the discharge port of the dispenser body and a second position in which the flow restrictor is spaced a second distance from the discharge port. The dispenser body and flow restrictor cooperate for dispensing liquid from the discharge port in a first dispensing pattern when the flow restrictor is in its first position and for dispensing liquid from the discharge port in a second dispensing pattern when the flow restrictor is in its second position. The first dispensing pattern differs from the second dispensing pattern.

In yet another aspect of the present invention, a liquid dispenser comprises a dispenser body and a spinner member. The dispenser body has a pump mechanism, an intake port adapted for fluid communication with a source of liquid, an intake liquid flow path providing fluid communication between the intake port and the pump mechanism, a discharge port, and a discharge liquid flow path providing fluid communication between the pump mechanism and discharge port. A first check valve is in the intake liquid flow path and is configured for permitting fluid flow from the intake port to the pump mechanism and for checking fluid flow from the pump mechanism to the intake port. A second check valve is in the discharge liquid flow path and is configured for permitting fluid to flow downstream from the pump mechanism to the discharge port and for checking fluid flow from the discharge port to the pump mechanism. The spinner member is in the discharge liquid flow path and is moveable relative to the dispenser body between a first position in which the spinner member is spaced from the discharge port of the dispenser body and a second position in which the spinner member is adjacent the discharge port. The dispenser body and spinner member cooperate for dispensing liquid from the discharge port in a first dispensing pattern when the spinner member is in its first position and for dispensing liquid from the discharge port in a second dispensing pattern when the spinner member is in its second position. The first dispensing pattern differs from the second dispensing pattern.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
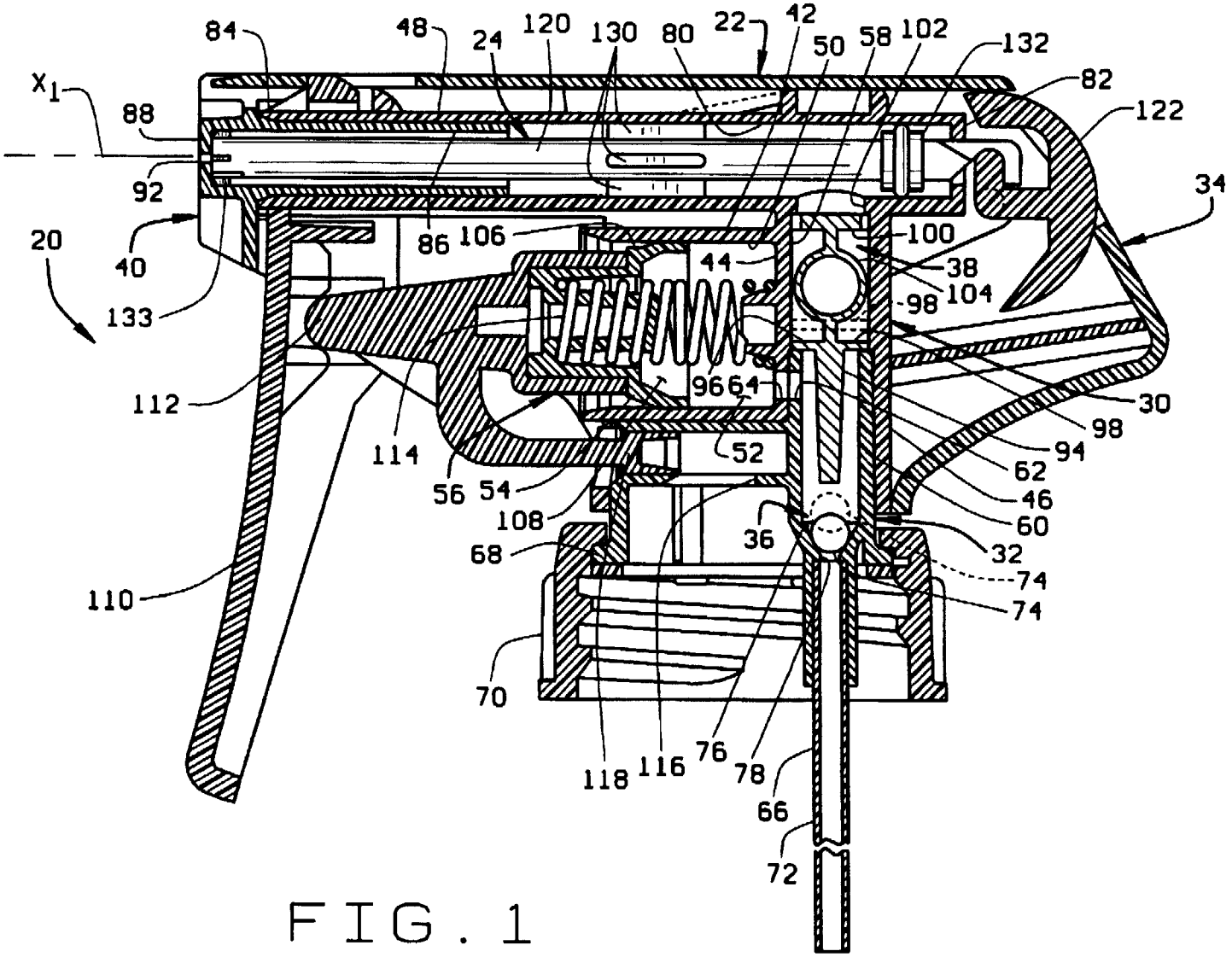
FIG. 1 is a side elevational view, in section, of a trigger sprayer of the present invention.

Referring now to the drawings, and first more particularly to FIG. 1, a spray-type dispenser of the present invention is indicated in its entirety by the reference numeral 20. The dispenser 20 comprises a dispenser body, generally indicated at 22, and a flow restrictor, generally indicated at 24. The dispenser body 22 comprises an upper housing member, generally indicated at 30, a lower housing member, generally indicated at 32, a shroud, generally indicated at 34 surrounding the upper housing member, a first check valve, generally indicated at 36, a second check valve, generally indicated at 38, and a nozzle head, generally indicated at 40. Preferably, each of these components is of a polymeric material. However, it is to be understood that some or all of the components may be of other materials without departing from the scope of this invention.

The upper housing member 30 of the dispenser body 22 includes a cylindric formation (wall) 42, a disc-shaped back wall 44 substantially closing one end (i.e., the right end as viewed in FIG. 1) of the cylindric wall, a generally cylindric vertical formation 46 adjacent the circular back wall, and a horizontal tubular portion 48 extending forward from the vertical formation. The cylindric wall 42 includes a generally cylindric inner surface 50. The inner surface 50 of the cylindric wall 42 and the disc-shaped back wall 44 define a pump chamber 52 open at one end (i.e., its left end as viewed in FIG. 1 for slidably receiving a pump piston 54. The pump chamber 52 and pump piston 54 constitute a pump mechanism, generally indicated at 56, of the dispenser body 22.

The vertical formation 46 of the upper housing member 30 has a vertical bore 58 extending upward from the bottom of the vertical formation 46. A lower end of the vertical bore 58 receives the lower housing member 32 of the dispenser body 22. More particularly, the lower housing member 32 has a generally cylindric column 60 extending upward into the vertical bore 58 in sealing engagement with the vertical formation 46. A lateral opening 62 through the wall of the cylindric column 60 is aligned with an opening 64 through the disc-shaped back wall 44 of the upper housing member 30 to provide fluid communication between the inside of the cylindric column and the pump chamber 52. The lower housing member 32 also has a nipple 66 extending down from the lower end of the cylindric column 60, and an annular flange 68.

Preferably a threaded collar 70 (or cap) is retained on the lower housing member 32 via the annular flange 68 for receiving a threaded neck of a liquid bottle (not shown). A dip tube 72 is sealingly press fit into the nipple and depends therefrom. The dip tube 72 is adapted to extend downward into liquid (not shown) within the bottle. The dip tube 72 constitutes a conduit for transporting liquid from the bottle upward into the dispenser body 22. Although the dispenser 20 preferably has a generally straight dip tube extending down into a bottle, it is to be understood that a long flexible tube could alternatively extend from the lower housing member 32 to a source of liquid remote from the sprayer.

The first (intake) check valve 36 comprises a ball 74, an annular valve seat 76 formed at the lower end of the cylindric column 54, and an opening 78 defined by the valve seat. The ball 74 of the check valve 36 is moveable between an open position (shown in phantom in FIG. 1) and a closed position (shown in solid in FIG. 1). In its open position, the ball 74 is spaced above the valve seat 76 to permit liquid to flow upward through the dip tube 72 and around the ball, and then into the pump chamber 46 via the cylindric column 60 and aligned openings 62, 64. The cylindric column 60 and aligned openings 62, 64 constitute an intake liquid flow path and the opening 78 constitutes an intake port (also indicated at 78) for the intake liquid flow path. In its closed position, the ball 74 seals against the valve seat 76 to plug the intake port 78 and thereby check fluid flow from the pump chamber 52 to the intake port 78.

The horizontal tubular portion 48 of the upper housing member 30 includes a horizontal bore 80 extending along an axis $X_1$ between rear and forward ends 82, 84 of the upper housing member. The upper end of the vertical formation 46 opens into the horizontal bore 80. The nozzle head 40 comprises a tubular projection 86 inserted into the horizontal bore 80 via the forward (downstream) end of the bore, a nozzle wall 88 at a forward end of the tubular projection, a nipple 90 (FIG. 4) extending rearwardly from the nozzle wall, and a nozzle orifice 92 through the nipple and nozzle wall and in fluid communication with the interior of the bore. The upper region of the vertical bore 58, the horizontal bore 80, and the interior of the tubular projection 86 constitute a discharge liquid flow path. The nozzle orifice 92 constitutes a discharge port of the discharge liquid flow path. As discussed in greater detail below, dispensed liquid flows from the pump chamber 52, through the aligned openings 62, 64, upward through the vertical bore 58, forward through the horizontal bore 80, and then out through the discharge port 92.

The second (discharge) check valve 38 is positioned in the vertical bore 58 and comprises a valve body 94 and an annular valve seat 96 formed at the upper end of the cylindric column 54. The valve body 94 comprises a disc-shaped lower plate 98 sized for covering the valve seat 96, an upper plate 100 sized for engaging an annular flange 102 extending radially inwardly from an upper end of the vertical formation 46, and a flat resilient ring 104 extending vertically between the upper and lower plates. The lower plate 98 is moveable between a closed position (shown in solid in FIG. 1) in which it seats against the valve seat 96, and an open position (shown in phantom in FIG. 1) in which it is positioned above the valve seat to permit liquid to flow upward through the valve seat and around the lower plate. The resilient ring 104 functions as a spring to bias the lower plate 98 in its closed position. Preferably, the upper plate 100 has a scalloped edge to permit liquid to flow upward between the flange 102 and upper plate 100 and into the horizontal bore 80. The discharge check valve 38 permits fluid flow downstream from the pump chamber 52 to the discharge port 92 and checks fluid flow from the discharge port to the pump chamber.

The pump piston 54 has a piston head 106 preferably formed of a suitable resilient material such as low density polyethylene. The piston head 106 comprises the rearward end (the right most end as viewed in FIG. 1) of the pump piston 54. The piston head 106 is slidable within the pump chamber 52 and configured for sealing engagement with the cylindric inner surface 50 of the pump chamber 52 all around the piston head 106 to seal against leakage of fluid between the pump piston 54 and cylindric inner surface 50. The piston head 106 and pump chamber 52 define a variable volume fluid receiving cavity 108. The pump piston 54 is reciprocally slidable in the pump chamber 52 between a first (extended) position and a second (compressed) position. When the pump piston 54 is in its extended position (shown in FIG. 1), the fluid receiving cavity 108 has a first (extended) volume. When the pump piston 54 is in its compressed position (not shown), the fluid receiving cavity has a second (compressed) volume which is smaller than the extended volume.

Preferably, the pump piston 54 is moved from its extended position to its compressed position by a trigger 110. The trigger 110 is connected at its upper end (not shown) to the upper housing member 30 for pivotal movement relative to the upper housing member (i.e., clockwise and counterclockwise movement as viewed in FIG. 1). The trigger 110 has a camming surface 112 engageable with a forward end (i.e., the left most end as viewed in FIG. 1) of the pump piston 54. Counterclockwise movement of the trigger 110 causes the camming surface 112 to push against the pump piston 54 and thereby move the pump piston rearwardly (i.e., from left to right as viewed in FIG. 1). A helical piston spring 114 is positioned between the disc-shaped back wall 44 of the pump chamber 52 and the pump piston 54 for urging the pump piston forward to its extended position. Thus, the pump piston 54 is rearwardly moved from its extended position to its compressed position by manually squeezing the trigger 110, and is automatically returned to its extended position via the piston spring 114 when the operator releases the trigger. After the pump has been primed, i.e., after air has been vented from the fluid receiving cavity 108, forward movement of the pump piston 54 creates vacuum pressure (i.e., negative pressure) in the fluid receiving cavity 108. This vacuum pressure causes liquid to be drawn from the bottle into the fluid receiving cavity 108 via the dip tube 72, intake port 78, and intake liquid flow path. Rearward movement of the pump piston 54 increases the pressure in the fluid receiving cavity 108. This increase in fluid pressure closes the intake check valve 36, opens the discharge check valve 38, and forces liquid out the discharge port 92 via the discharge liquid flow path.

Preferably, a bottle vent opening 116 is in the lower housing member 32 for opening the top of the bottle to atmosphere. A plug 118 (FIG. 1) is integrally connected to the pump piston 54 and moveable therewith. The plug 118 is adapted for closing the bottle vent opening 116 when the dispenser 20 is not in use to prevent liquid from spilling out of the bottle via the opening.

Figure 2:
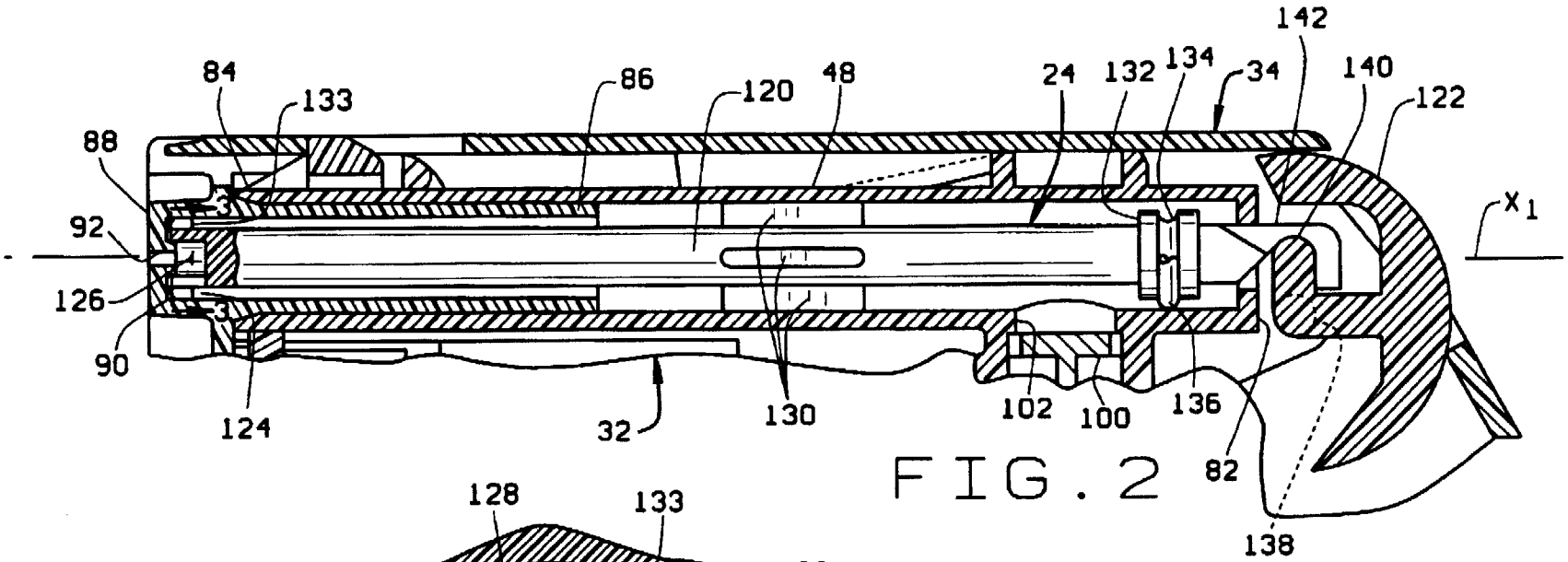
FIG. 2 is an enlarged fragmented sectional view of an upper portion of the trigger sprayer of FIG. 1 showing a flow restrictor extending into a discharge liquid pathway of the sprayer and moveable therein via a thumbwheel for varying the discharge of liquid between a first discharge pattern (e.g., a stream) and a second discharge pattern (e.g., a spray)
Figure 3:
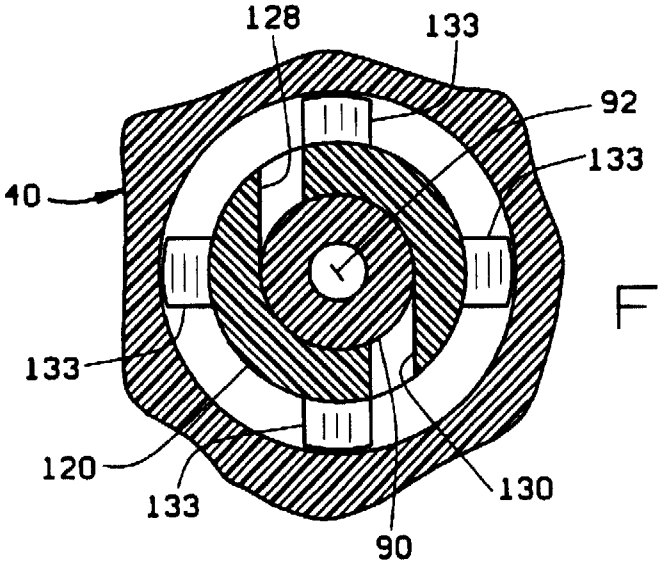
FIG. 3 is an enlarged cross-sectional view taken along the plane of line 3—3 of FIG. 2 showing a spinner of the flow restrictor.

Referring to FIGS. 1–4, the flow restrictor 24 comprises a rod 120 extending forward from the rear end 82 of the upper housing member 30 through the horizontal bore 80 and into the tubular projection 86 of the nozzle head 40, and a positioning member (i.e., thumbwheel 122) attached to a rear end of the rod 120 for moving the rod along the axis $X_1$. A spinner 124 is formed in a forward (downstream) end portion of the rod 120 for imparting a swirl to liquid flowing forward through the discharge liquid flow path. As shown in FIG. 3, it comprises a generally cylindric swirl chamber 126 and two openings 128 extending substantially tangentially from the swirl chamber.

The rod 120 is moveable within the horizontal bore 80 between a forward position (FIG. 2) in which the spinner 124 engages the nipple 90 of the nozzle head 40 and is adjacent the discharge port 92, and a rearward position (FIG. 4) in which the spinner is spaced rearwardly (i.e., upstream) from nipple and the discharge port. When the rod 120 is in its forward position (FIGS. 2 and 3), the rearwardly extending nipple 90 of the nozzle head 40 extends into the forward most portion of the swirl chamber 126. Preferably, the nipple 90 is sized and configured for sealingly engaging the forward end of the spinner 124 when the rod 120 is in its forward position to prevent leakage between the nipple and forward end of the spinner. When the spinner 124 is so positioned, substantially all liquid flowing downstream through the discharge liquid flow path passes through the tangential openings 128 and is swirled in the swirl chamber 126 before it is discharged through the discharge port 92. Thus, when the rod 120 is in its forward position, liquid is dispensed through the discharge port 92 in a spray pattern.

When the rod 120 is in its rearward position (FIG. 4), i.e., when the spinner 124 is spaced from the nipple 90 of the nozzle head 40, only a small percentage of the liquid dispensed through the discharge port 92 will first pass through the tangential openings 128 and swirl chamber 126; most of the dispensed liquid will flow forward over the forward end of the spinner 124 and through the discharge port 92 without passing through the swirl chamber. Thus, when the rod 120 is in its rearward position, liquid is dispensed through the discharge port 92 in a first dispensing pattern (e.g., a stream), and when the rod is in its forward position, liquid is dispensed through the discharge port 92 in a second dispensing pattern (e.g., a spray).

The dispensing pattern may be tailored to a user's particular need by moving the rod 120 along the axis $X_1$ to a position between the forward and rearward positions. The closer the spinner 124 is to the nipple 90 of the nozzle head 40, the higher the percentage of dispensed liquid which will flow through the swirl chamber 126. Thus, forward movement of the rod 120 increases atomization of dispensed liquid and rearward movement of the rod decreases atomization of the dispensed liquid.

The flow restrictor 24 further includes a plurality of centering fins 130 (preferably four) extending radially from an intermediate portion of the rod 120 and centering fins 133 at the forward end of the rod 120 for centering the rod within the horizontal bore 80 as the rod is moved between its forward and rearward positions. The rod 120 has an enlarged-diameter portion 132 adjacent a rearward end of the horizontal bore 80 with an annular groove 134 (FIG. 2) for receiving an O-ring seal 136. The O-ring seal 136 slidingly engages the horizontal bore 80 for preventing leakage of liquid out the rearward end of the horizontal bore.

Figure 4:
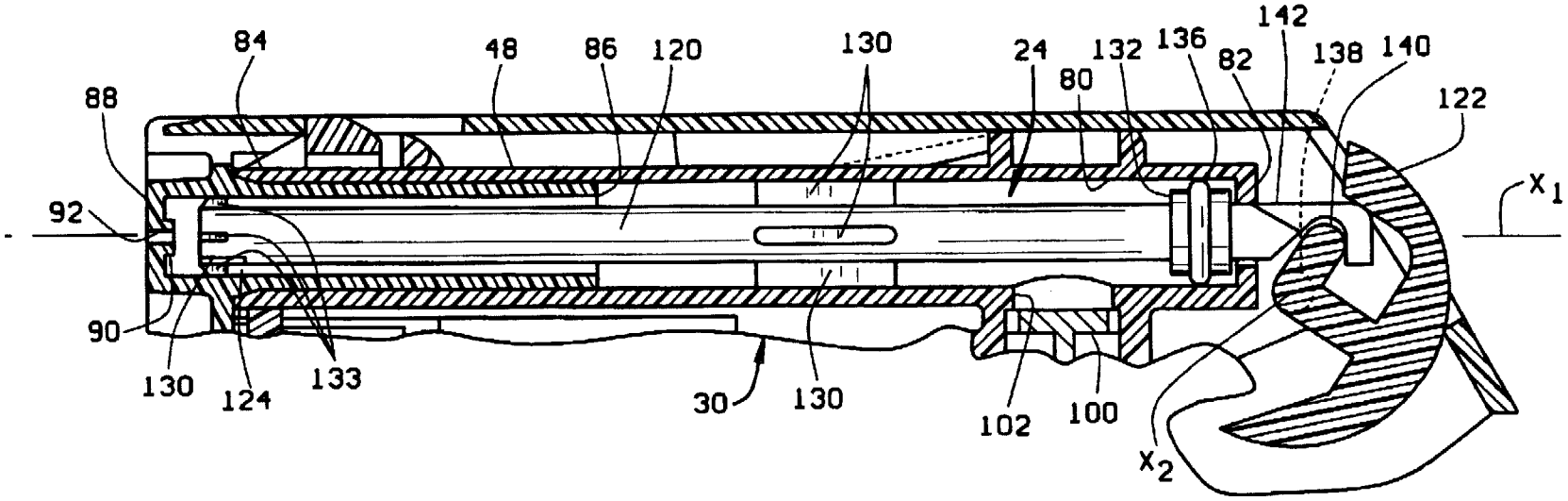
FIG. 4 is a view similar to FIG. 2 but showing the flow restrictor moved to a rearward position.

The thumbwheel 122 includes a pair of trunnions 138 (shown in hidden lines in FIGS. 2 and 4) which are snap fit in generally cylindric recesses (not shown) formed in the upper housing member for movement of the thumbwheel about an axis $X_2$ (which is perpendicular to the page as viewed in FIGS. 2 and 4). The thumbwheel 122 includes a camming surface 140 which engages a hooked follower 142 formed at the rear end of the rod 120. The camming surface 140 and hooked follower 142 are configured so that rotation of the thumbwheel 122 about the axis $X_2$ between a first thumbwheel position (FIG. 2) and a second thumbwheel position (FIG. 4) causes the rod 120 to move between its forward and rearward positions.

Although the rod 120 is shown as being moved between its forward and rearward positions by a thumbwheel, it is to be understood that the rod could be so moved via alternative elements without departing from the scope of this invention.

Figure 5:
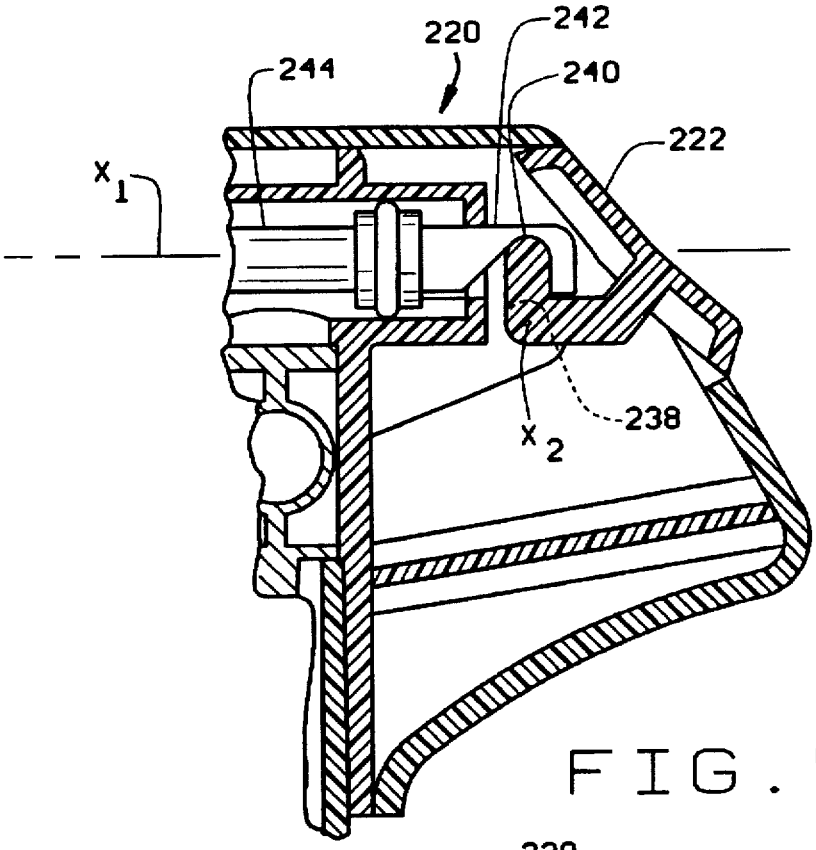
FIG. 5 is an enlarged fragmented sectional view of the rear portion of another trigger sprayer of the present invention similar to the trigger sprayer of FIGS. 1–4 but having a toggle switch instead of a thumbwheel.

Another embodiment of a sprayer of the present invention is indicated generally at 220 in FIG. 5. The sprayer 220 of FIG. 5 is identical to the sprayer of FIGS. 1–4 except the sprayer of FIG. 5 has a toggle switch 222 instead of a thumbwheel for moving the rod along the axis $X_1$. Similar to the thumbwheel 122 of FIGS. 1–4, the toggle switch 222 includes a pair of trunnions 238 (shown in hidden lines in FIG. 5) which are snap fit in generally cylindric recesses (not shown) formed in the upper housing member for movement of the toggle switch about the axis $X_2$. A camming surface 240 of the toggle switch 222 engages the hooked follower 242 of the rod 244 so that rotation of the toggle switch about the axis $X_2$ causes the rod to move between its forward position to its rearward position.

Figure 6:
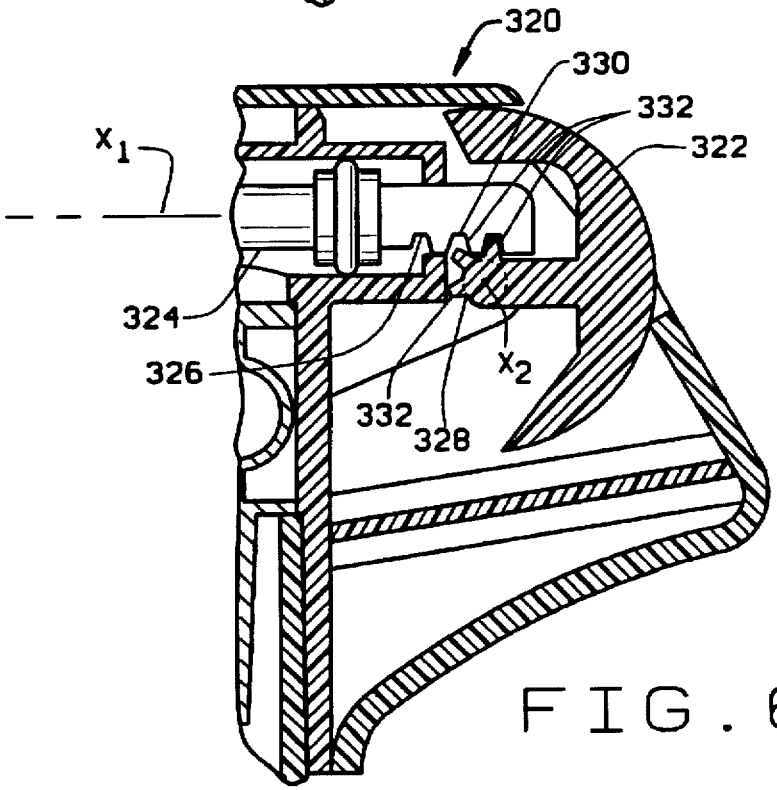
FIG. 6 is an enlarged fragmented sectional view of the rear portion of another trigger sprayer of the present invention similar to the trigger sprayer of FIGS. 1–4 but having a thumbwheel connected to a rod via a rack and pinion, the thumbwheel being shown in a first position.
Figure 7:
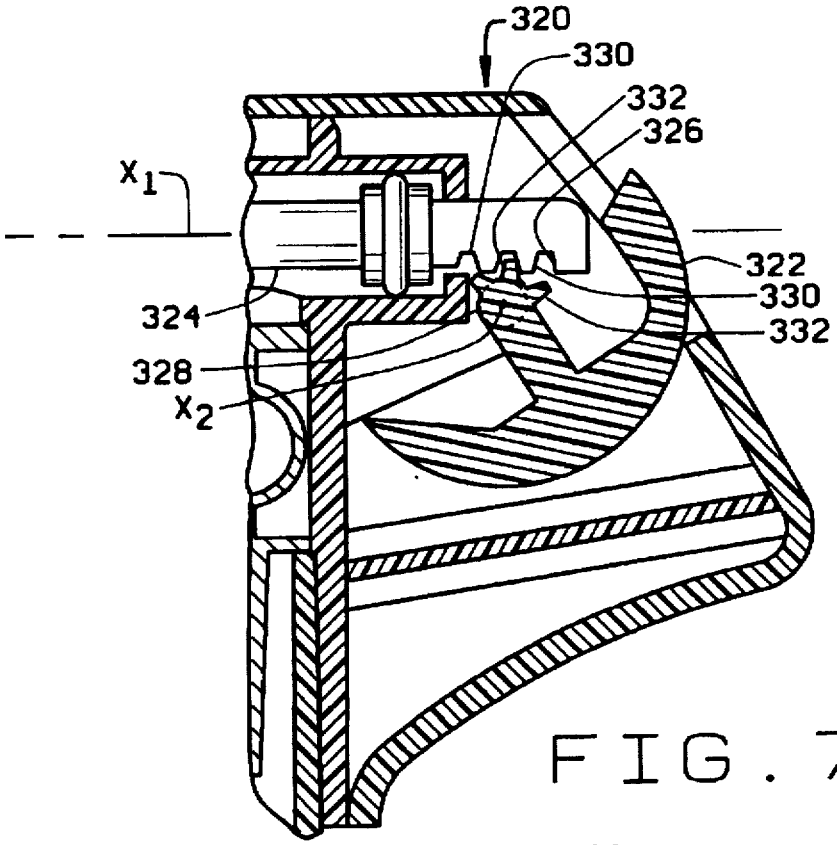
FIG. 7 is a view similar to FIG. 6 but showing the thumbwheel of FIG. 6 turned to a second position.

Another embodiment of a trigger sprayer of the present invention is indicated generally at 320 in FIGS. 6 and 7. The sprayer 320 is identical to the sprayer 20 except its thumbwheel 322 is connected to a rod 324 via a rack 326 and pinion 328. The rack 326 is formed generally at a rearward end of the rod 324 and includes gear teeth 330. The pinion 328 is formed on the thumbwheel 322 and includes gear teeth 332 configured for meshing with the gear teeth 330 of the rack 326. Movement of the thumbwheel 322 about the axis $X_2$ between a first position (FIG. 6) and a second position (FIG. 7) causes movement of the rod 324 between forward and rearward positions.

Although not shown, it is to be understood that a rack and pinion could likewise be used in conjunction with a toggle switch without departing from the scope of this invention.

Figure 8:
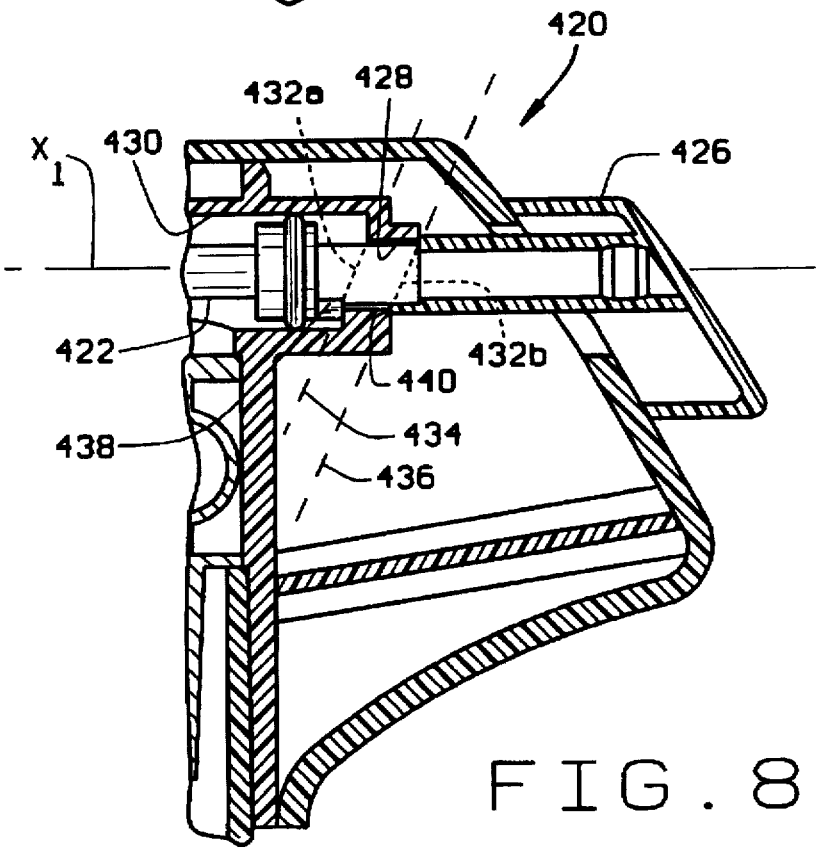
FIG. 8 is an enlarged fragmented sectional view of the rear portion of another trigger sprayer of the present invention similar to the trigger sprayer of FIGS. 1–4 but having a twist knob mechanism for moving the rod between its forward and rearward positions, the twist knob being shown in a first position.
Figure 9:
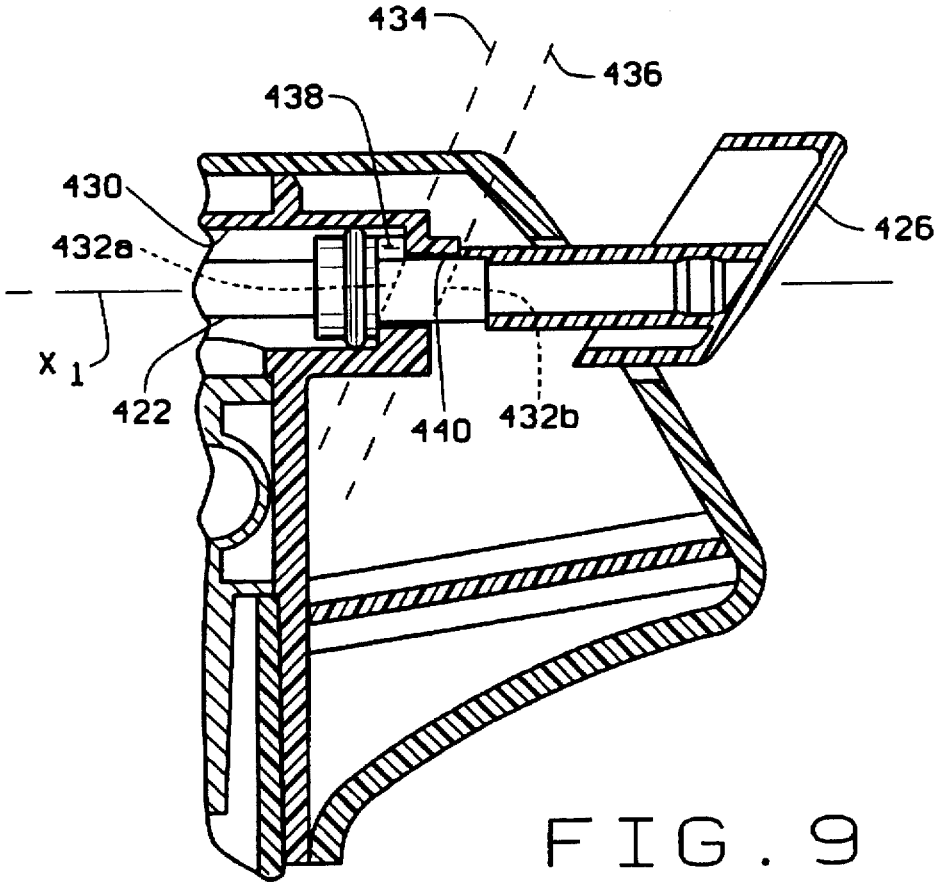
FIG. 9 is a view similar to FIG. 8 but showing the twist knob in a second position.

Referring now to FIGS. 8 and 9, another embodiment of a trigger sprayer of the present invention is indicated generally at 420. The sprayer 420 is identical to the sprayer 20 of FIGS. 1–4 except the rod 422 is moved along the axis $X_1$ via a twist knob 426. The rear end of the rod 422 is press fit into the twist knob 426 so that the twist knob and rod may be rotated together about the axis $X_1$. The rod 422 extends horizontally through a hole 428 formed generally at the rear end of the upper housing member and aligned with the horizontal bore 430. The hole 428 is defined by front and rear elliptically shaped edges **432*a*, 432*b* of the upper housing member. The elliptically shaped edges 432 lie generally in parallel inclined plane indicated at 434, 436 (FIG. 8). A protrusion 438 extends radially from the rod 422 and engages the front elliptically shaped edge 432*a*. A forward end 440 of the twist knob 426 engages the rear elliptically shaped edge 432*b*. The elliptically shaped edges 432*a*, 432*b* constitute a track along which the protrusion 438 and forward end 440 of the twist knob 426 travel as the knob and rod 422 are rotated about the axis $X_1$ between a first position (FIG. 8) and a second position (FIG. 9). Movement of the twist knob 426 between its first and second positions causes the rod to move between forward and rearward positions (similar to the rod 120 discussed above with reference to FIGS. 1–4**).

Figure 10:
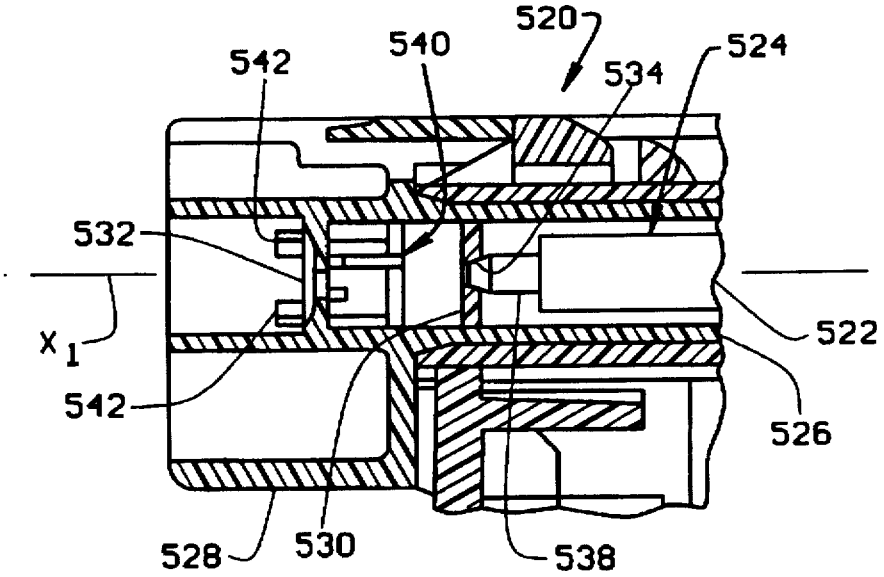
FIG. 10 is an enlarged fragmented sectional view of the discharge region of another trigger sprayer of the present invention similar to the trigger sprayer of FIGS. 1–4 but having a flow restrictor moveable between open and closed positions, the flow restrictor being shown in its closed position.
Figure 11:
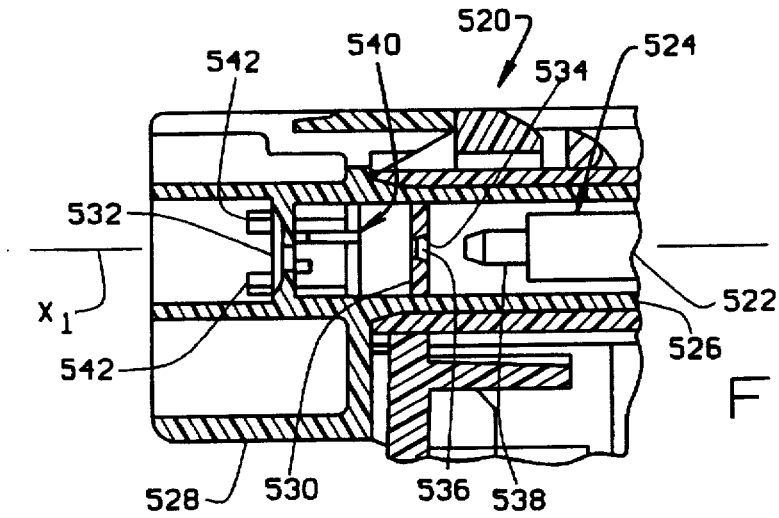
FIG. 11 is a view similar to FIG. 10 but showing the flow restrictor in its open position.

Referring now to FIGS. 10 and 11, yet another embodiment of a trigger sprayer of the present invention is indicated by the reference numeral 520. The sprayer 520 is similar to the sprayer 20 of FIGS. 1–4 except for the discharge region of the sprayer.

The sprayer 520 includes a rod 522 of a flow restrictor 524 extending into a tubular projection 526 of a nozzle head 528. The nozzle head 528 includes a disc-shaped baffle wall 530 inside the tubular projection 526 and upstream of the discharge port 532. The baffle wall 530 includes an annular valve seat 534 defining an orifice 536 for passage of liquid therethrough.

Preferably, the forward end of the rod 522 comprises a valve body 538 in the form of a tapered stem configured for seating against the valve seat 534. The rod 522 is moveable along an axis $X_1$ between a forward (closed) position (FIG. 10) in which the valve body 538 seats against the valve seat 534 to prevent passage of liquid through the orifice 536 and a rearward (open) position (FIG. 11) in which the valve body is spaced rearward (upstream) of the baffle wall 530 to permit liquid to flow around the rod and through the orifice and then downstream through the discharge port 532. Preferably, a spinner member 540 is positioned adjacent the discharge port 532 for swirling the liquid as it is discharged through the discharge port. Also preferably, the nozzle head 528 includes foamer members 542 having openings (not shown) therein for introducing air into the spinning liquid as it is dispensed to cause the liquid to foam. Thus, when the rod 522 of the flow restrictor 524 is in its open position (FIG. 11), liquid flowing downstream through the discharge liquid flow path flows around the valve body 538, through the orifice 536, is swirled by the spinner member 540, and is aerated by the foamer members 542 so that it is dispensed in a foam. When the rod 522 is in its closed position (FIG. 10), the valve body 538 seals the orifice 536 closed to prevent passage of fluid through the discharge liquid flow path. Although not specifically shown, it is to be understood that the rod 522 may be moved along the axis $X_1$ between its open and closed positions by any of the mechanisms discussed above with reference to FIGS. 1–9, or by any other suitable mechanism.

Figure 12:
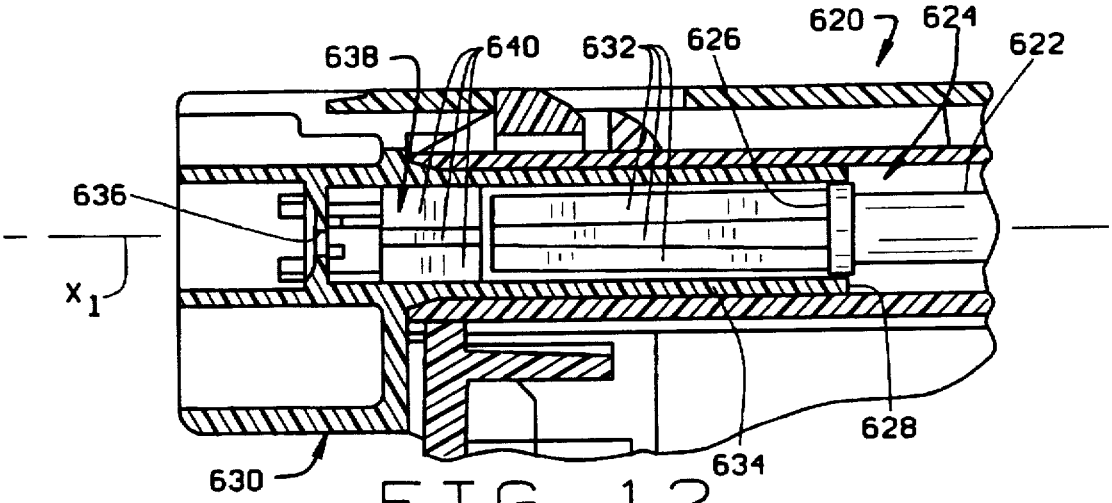
FIG. 12 is an enlarged fragmented sectional view of the discharge region of another trigger sprayer similar to the trigger sprayer of FIGS. 10 and 11 but having a flow restrictor with a differently shaped valve member, the flow restrictor being shown in its closed position.
Figure 13:
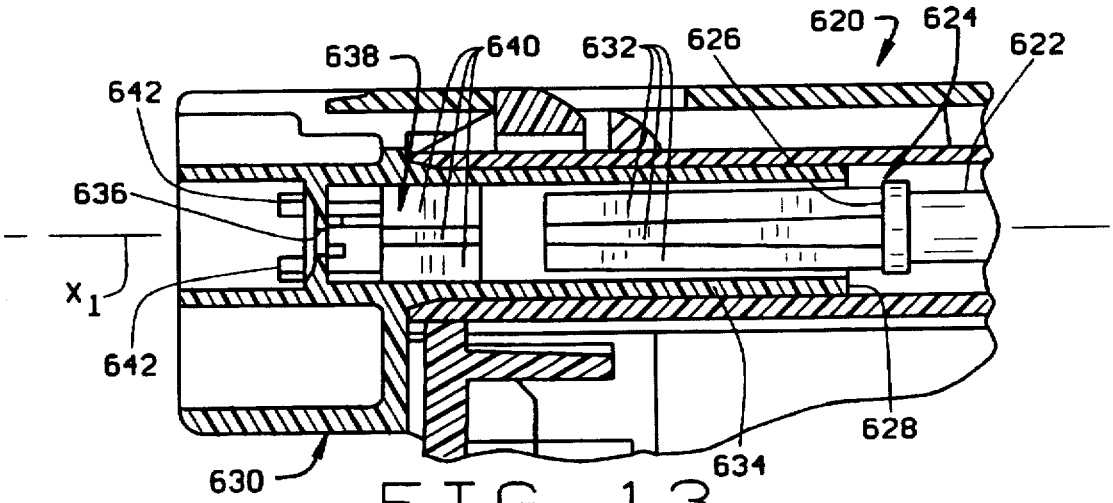
FIG. 13 is a view similar to FIG. 12 but showing the flow restrictor in its open position.

Referring now to FIGS. 12 and 13, another embodiment of a trigger sprayer of the present invention is indicated by the reference numeral 620. The sprayer 620 is similar to the sprayer 520 of FIGS. 10 and 11 except for the valve mechanism and the spinner. The rod 622 of the flow restrictor 624 includes a disc-shaped valve member 626 configured for seating against a rear end 628 of the tubular projection 634 of the nozzle head 630. A plurality of alignment fins 632 extend radially outwardly from a forward portion of the rod 622 to maintain the valve member 626 in coaxial alignment with the tubular projection 634. The rod 622 is moveable along an axis $X_1$ between a forward (closed) position (FIG. 12) in which the valve member 626 seats against the rear end 628 of the tubular projection 634 of the nozzle head 630 to prevent passage of liquid through the tubular projection and a rearward (open) position (FIG. 13) in which the valve member is spaced rearward (upstream) of the tubular projection to permit liquid to flow into the nozzle head and through the discharge port 636. Preferably, a spinner member 638 is positioned adjacent the discharge port 636 for swirling the liquid as it is discharged through the discharge port. The spinner member 638 preferably includes a plurality of fins 640 extending radially from a rearward portion thereof to fractionally hold the spinner member in the tubular projection 634 of the nozzle head 630. Also preferably, the nozzle head 630 includes roamer members 642 having openings (not shown) therein for introducing air into the spinning liquid as it is dispensed to cause the liquid to foam. Thus, when the rod 622 of the flow restrictor 624 is in its open position, liquid flowing downstream through the discharge liquid flow path flows around the valve member 626, through the tubular projection 634, is swirled by the spinner member 638, and is aerated by the foamer members 642 so that it is dispensed in a foam. When the rod 622 is in its closed position (FIG. 12), the valve member 626 seals against the rear end 628 of the tubular projection 634 to prevent passage of fluid through the discharge liquid flow path.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. It is intended that the invention shall be limited solely by the scope of the claims.

What is claimed is:

1. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, a discharge liquid flow path providing fluid communication between the pump mechanism and discharge port, and a second check valve in the discharge liquid flow path configured for permitting fluid to flow downstream from the pump mechanism to the discharge port and for checking fluid flow from the discharge port to the pump mechanism; and a flow restrictor in the discharge liquid flow path moveable between first and second positions, said flow restrictor being configured for permitting fluid flow from the pump mechanism to the discharge port when the flow restrictor is in its first position, said flow restrictor being configured for at least partially impeding fluid flow from the pump mechanism to the discharge port when the flow restrictor is in its second position.

2. A liquid dispenser as set forth in claim 1 wherein the flow restrictor is configured for preventing fluid flow from the pump mechanism to the discharge port when the flow restrictor is in its second position.

3. A liquid dispenser as set forth in claim 1 further comprising a positioning member for facilitating movement of the flow restrictor between its first and second positions, said positioning member being mounted on the dispenser body for movement relative to the dispenser body between first and second positions, said positioning member being operatively connected to said flow restrictor such that movement of the positioning member between its first and second positions causes movement of flow restrictor between its first and second positions.

4. A liquid dispenser as set forth in claim 3 wherein said positioning member comprises a toggle switch.

5. A liquid dispenser as set forth in claim 3 wherein said positioning member comprises a twist knob.

6. A liquid dispenser as set forth in claim 3 wherein said positioning member comprises a thumbwheel.

7. A liquid dispenser as set forth in claim 3 wherein the dispenser body further includes an elongate conduit, said elongate conduit at least in part defining the discharge fluid pathway, said flow restrictor being configured for moving within the elongate conduit along a longitudinal axis $X_1$ of the elongate conduit upon movement of the positioning member between its first and second positions.

8. A liquid dispenser as set forth in claim 7 wherein said flow restrictor is mounted to the dispenser body for sliding movement relative to the dispenser body along said longitudinal axis $X_1$ between its first and second positions.

9. A liquid dispenser as set forth in claim 7 wherein said positioning member is mounted on the dispenser body for pivoting about said longitudinal axis $X_1$ between its first and second positions.

10. A liquid dispenser as set forth in claim 7 wherein said positioning member is mounted on the dispenser body for pivoting about an axis $X_2$, different from said axis $X_1$.

11. A liquid dispenser as set forth in claim 7 wherein said flow restrictor is configured for blocking fluid flow from the pump mechanism to the discharge port when the flow restrictor is in its second position.

12. A liquid dispenser as set forth in claim 1 wherein said dispenser body and flow restrictor cooperate to dispense liquid from the discharge port in a first dispensing pattern when the flow restrictor is in its first position and to dispense liquid from the discharge port in a second dispensing pattern when the flow restrictor is in its second position, the first dispensing pattern differing from the second dispensing pattern.

13. A liquid dispenser as set forth in claim 12 wherein the first dispensing pattern comprises a stream and wherein the second dispensing pattern comprises a spray pattern.

14. A liquid dispenser as set forth in claim 1 wherein said flow restrictor includes a spinner having a swirl chamber for swirling the liquid in the discharge liquid flow path before the liquid is dispensed through the discharge port.

15. A liquid dispenser as set forth in claim 1 wherein the flow restrictor is spaced a first distance from the discharge port when the flow restrictor is in its first position, and is spaced a second distance from the discharge port when the flow restrictor is in its second position.

16. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, a discharge liquid flow path providing fluid communication between the pump mechanism and discharge port, and a second check valve in the discharge liquid flow path configured for permitting fluid to flow downstream from the pump mechanism to the discharge port and for checking fluid flow from the discharge port to the pump mechanism; and a flow restrictor in the discharge liquid flow path moveable relative to the dispenser body between a first position in which the flow restrictor is spaced a first distance from the discharge port of the dispenser body and a second position in which the flow restrictor is spaced a second distance from the discharge port;

said dispenser body and flow restrictor cooperating for dispensing liquid from the discharge port in a first dispensing pattern when the flow restrictor is in its first position and for dispensing liquid from the discharge port in a second dispensing pattern when the flow restrictor is in its second position, the first dispensing pattern differing from the second dispensing pattern.

17. A liquid dispenser as set forth in claim 16 wherein the first dispensing pattern comprises a stream and wherein the second dispensing pattern comprises a spray pattern.

18. A liquid dispenser as set forth in claim 16 wherein the flow restrictor includes a spinner having a swirl chamber for swirling the liquid in the discharge liquid flow path before the liquid is dispensed through the discharge port.

19. A liquid dispenser as set forth in claim 18 wherein the flow restrictor and dispenser body are configured such that at least some liquid flowing through the discharge liquid flow path and out the discharge port bypasses the swirl chamber when the flow restrictor is in its first position.

20. A liquid dispenser as set forth in claim 16 further comprising a positioning member for facilitating movement of the flow restrictor between its first and second positions, said positioning member being mounted on the dispenser body for movement relative to the dispenser body between first and second positions, said positioning member being operatively connected to said flow restrictor such that movement of the positioning member between its first and second positions causes movement of flow restrictor between its first and second positions.

21. A liquid dispenser as set forth in claim 20 wherein the dispenser body further includes an elongate conduit, said elongate conduit at least in part defining the discharge fluid pathway, said flow restrictor being configured for moving within the elongate conduit along a longitudinal axis $X_1$ of the elongate conduit upon movement of the positioning member between its first and second positions.

22. A liquid dispenser as set forth in claim 21 wherein said positioning member is mounted on the dispenser body for pivoting about said longitudinal axis $X_1$ between its first and second positions.

23. A liquid dispenser as set forth in claim 21 wherein said positioning member is mounted on the dispenser body for pivoting about an axis $X_2$, different from said axis $X_1$.

24. A liquid dispenser as set forth in claim 16 wherein the flow restrictor is adjacent the discharge port when the flow restrictor is in its second position.

25. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, a discharge liquid flow path providing fluid communication between the pump mechanism and discharge port, and a second check valve in the discharge liquid flow path configured for permitting fluid to flow downstream from the pump mechanism to the discharge port and for checking fluid flow from the discharge port to the pump mechanism; and a spinner member in the discharge liquid flow path moveable relative to the dispenser body between a first position in which the spinner member is spaced from the discharge port of the dispenser body and a second position in which the spinner member is adjacent the discharge port;

said dispenser body and spinner member cooperating for dispensing liquid from the discharge port in a first dispensing pattern when the spinner member is in its first position and for dispensing liquid from the discharge port in a second dispensing pattern when the spinner member is in its second position, the first dispensing pattern differing from the second dispensing pattern.

* * * * *